United States Patent [19]

Lentino

[11] Patent Number: 5,070,562

[45] Date of Patent: Dec. 10, 1991

[54] COMBINATION ACCESSORY FOR A POWER TOOL

[75] Inventor: Lynn E. Lentino, Westminster, Md.

[73] Assignee: Black & Decker Inc., Newark, Del.

[21] Appl. No.: 586,929

[22] Filed: Sep. 24, 1990

[51] Int. Cl.[5] ..... B25F 1/00

[52] U.S. Cl. ..... 7/164; 7/169; 33/481; 83/745

[58] Field of Search ..... 7/138, 164, 169; 33/429, 474, 479, 481; 83/745

[56] References Cited

U.S. PATENT DOCUMENTS

| | | | |
|---|---|---|---|
| 363,331 | 5/1887 | Hammer . | |
| 1,048,333 | 12/1912 | Mishler | 33/481 |
| 1,562,018 | 11/1925 | Warff . | |
| 2,773,523 | 12/1956 | Hopla | 83/745 |
| 4,641,435 | 2/1987 | Brown | 33/474 X |
| 4,790,072 | 12/1988 | Edwards | 83/745 X |

*Primary Examiner*—James G. Smith

*Attorney, Agent, or Firm*—Dennis A. Dearing; John D. Del Ponti; Charles E. Yocum

[57] ABSTRACT

A receptacle (74) in the shoe (12) of a circular saw (14) holds an accessory tool (10) which combines the functions of blade wrench and square. The base (18) of the L-shaped tool (10) is bent to provide an offset bearing surface (52) to facilitate its use as a square. The base (18) also includes a hexagonal wrench opening (46) sized to fit the saw blade retaining nut (48). An interrupted longitudinal groove (26) in the "upright" portion (16) of the L helps guide the tool (10) into the receptacle (74) and hold it there.

9 Claims, 3 Drawing Sheets

COMBINATION ACCESSORY FOR A POWER TOOL

BACKGROUND OF THE INVENTION

The invention concerns accessory tools of the type which are used with great frequency in association with a particular power tool and means for maintaining such accessory tools conveniently accessible while the power tool is in use.

Portable power tools sometimes incorporate a holder carrying the most frequently used accessory tool so that that tool is always conveniently available when needed. This is particularly true and useful for tools such as drills and circular saws where a cutting element (drill bit or saw blade) must be changed frequently. But often there is a secondary accessory tool also frequently, if not constantly, used for which no special provision is made. An example of the latter is a square with a graduated blade, used with a circular saw for marking on a workpiece the next intended cut such as a narrow rip.

Given that encumbering a power tool with even one accessory may be accepted with some reluctance by the tool designer because of space and weight constraints, second accessory tools are even less likely to find a home on the power tool. This is especially true if they are of awkward shape and relatively bulky, such as a square as typically used with a circular saw.

SUMMARY OF THE INVENTION

Accordingly, it is an object of the invention to provide for a portable power tool, means for maintaining at least two accessory tools together. A further object is to maintain such tools conveniently available to the power tool operator but with a minimum of encumbrance to the power tool and its operation.

Another object is to achieve the first two objects at low cost and with simple structure.

These objects may be realized, at least in part, by providing a tool which combines the functions of at least two accessory tools in a compact and economical configuration and preferably in a configuration which is adaptable to being carried on a power tool. In an exemplary preferred embodiment for circular saw accessories, a blade wrench is combined with a square and configured to be easily stored or carried on the saw with a minimum of protruberance or extension of the overall dimensions of the saw.

The combination accessory tool may be L-shaped and a first leg of the L stored or accommodated in the shoe of the saw while the other leg extends adjacent the shoe. Preferably the first leg is carried longitudinally substantially in the plane of the shoe, while the second leg extends transversely and preferably also generally within the plane of the shoe.

The combination accessory tool may provide the functions of a square which typically comprises an elongated planar blade (providing a graduated marking edge) and, perpendicular to it, a butt or base member providing a reference or support surface in a plane perpendicular to the plane of the blade. The butt preferably has some "thickness" or offset relative to the plane of the blade if it is to be used for squaring on the surface of a workpiece using the edge of the workpiece as a reference. It is a feature of the invention that the combination accessory tool may be made from an L-shaped sheet metal or metal plate blank and the necessary perpendicular butt surface established by bending the butt portion in at least one place along a line perpendicular to the longitudinal axis of the blade portion, thus offsetting the butt portion in a direction perpendicular to the plane of the blade.

The wrench function of the accessory tool may be provided by making a suitable aperture in one of the legs of the L-shaped accessory tool. Preferably the wrench aperture is made in the butt portion of the accessory tool so that an offset in the butt portion not only provides the reference surface for the square function but also the equivalent of the common angling or offsetting of a wrench handle for facilitating its use.

In a preferred embodiment, a combination square/wrench is carried by the shoe of a circular saw with the blade portion of the square inserted in a slot of the saw shoe and extending longitudinally while the butt portion of the square abuts the rear edge of the shoe. The blade portion of the square and the slot arrangement of the shoe may have cooperating surfaces to help guide the blade into the shoe. Preferably a latch is associated with the guide surfaces for positively retaining the combination accessory tool in the shoe.

DESCRIPTION OF THE PREFERRED EMBODIMENT

Figure 1:
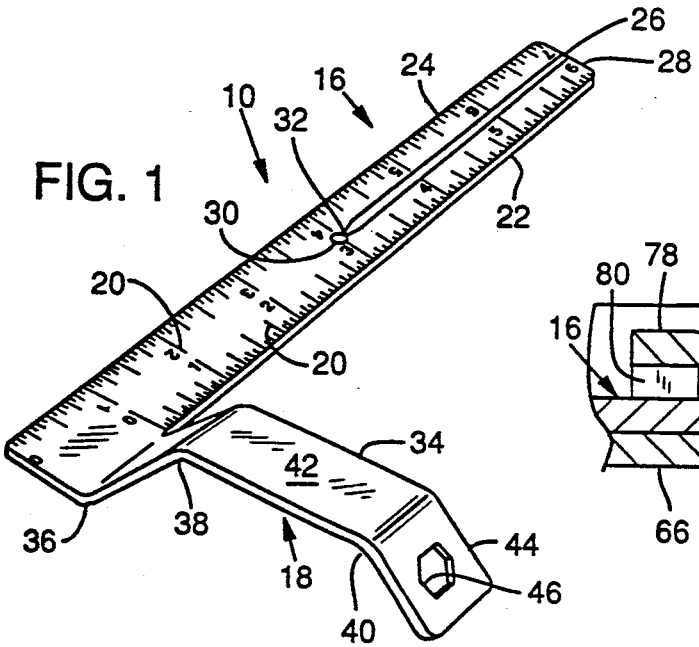
FIG. 1 is a perspective view of the combination accessory tool of an embodiment of the invention.
Figure 2:
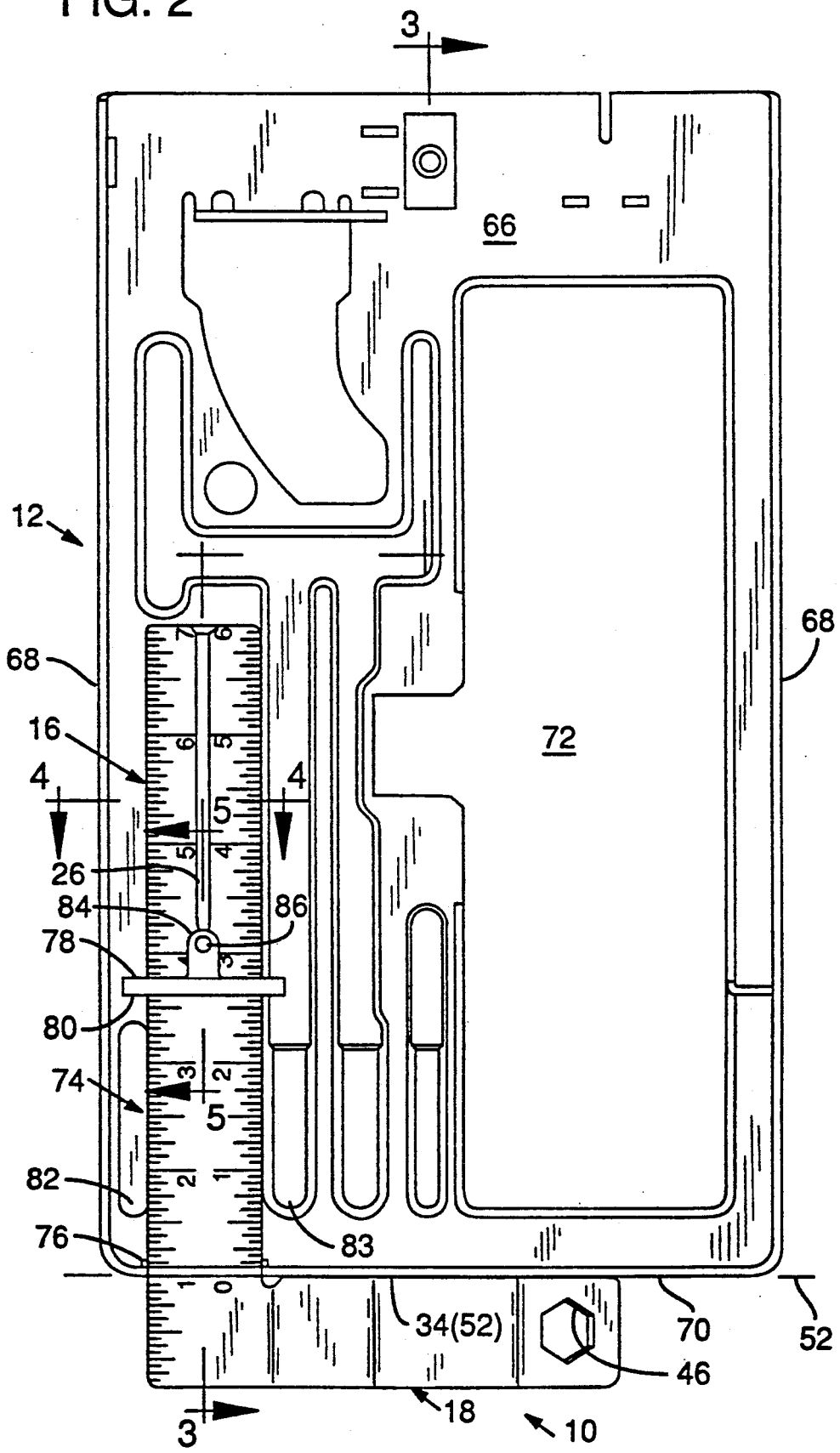
FIG. 2 is an overhead view of the shoe of a circular saw and accessory tool combination embodying the invention, showing the accessory tool in stored position in the shoe.
Figure 3:
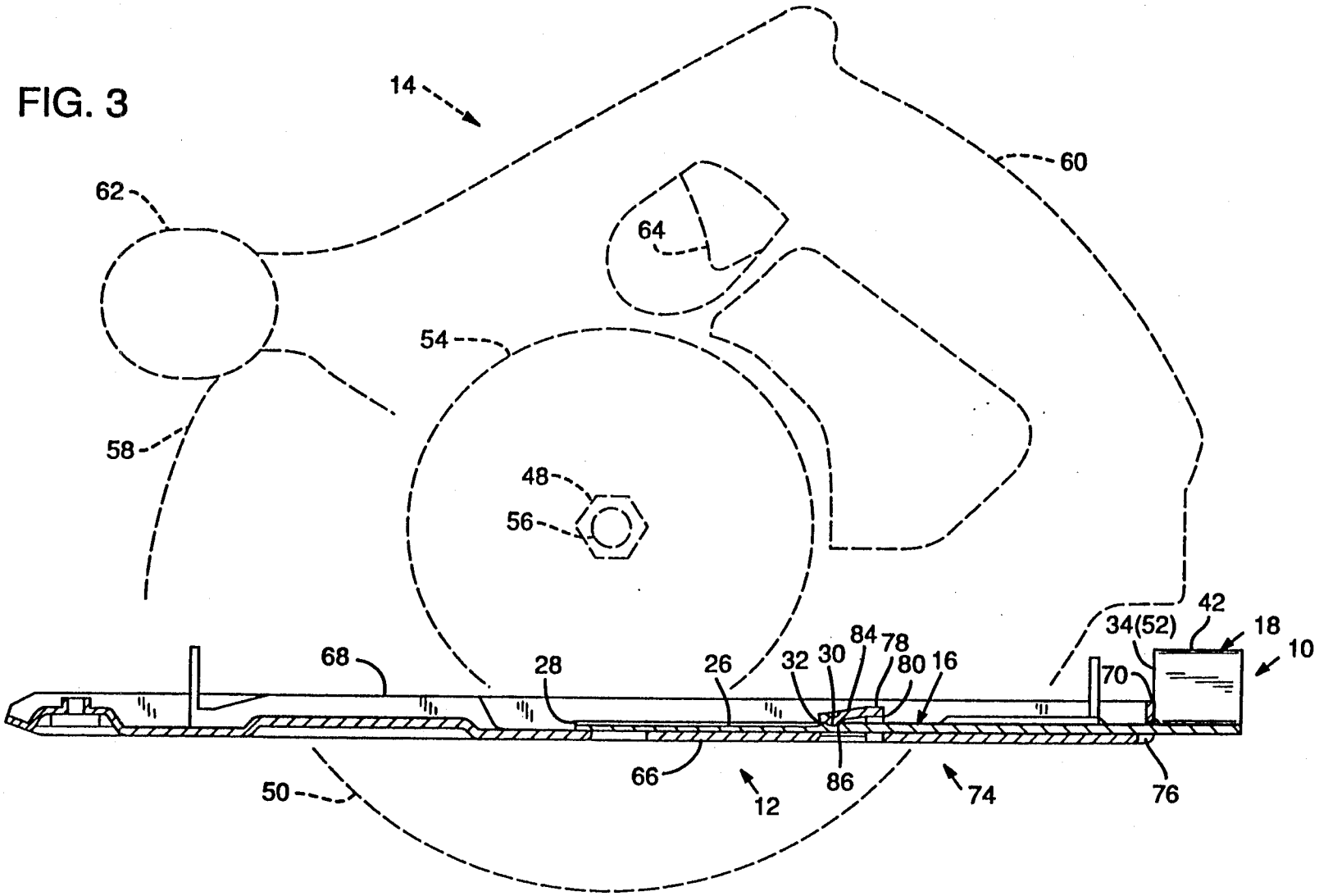
FIG. 3 is a cross sectional view taken on line 3—3 of FIG. 2 of the shoe of the circular saw in stored position with the remainder of the saw shown in phantom outline.

The invention is embodied in the combination square and wrench 10 shown in FIG. 1 and adapted for carrying in the shoe 12 of a circular saw 14 as seen best in FIGS. 2 and 3. The saw as a whole is generally conventional and is shown only in FIG. 3 and only in phantom outline.

The square/wrench 10 consists of an elongated blade 16 and, extending substantially rigidly and perpendicularly from an end of the blade, a foot or base portion 18. Blade 16 and base portion 18 may be of equal uniform thickness and the square/wrench 10 is preferably made from a metal stamping. The blade 16 carries conventional graduations 20 for facilitating the measurement of a workpiece. The inside and outside edges 22, 24 of the blade 16 are straight and parallel. A shallow groove 26, parallel to the edges 22, 24 and the longitudinal axis of the blade, extends partially along the length of the blade from its free end 28. Close to the end of the groove 26 and longitudinally in line with it is a shallow indentation or dimple 30. The dimple 30 may be considered an extension of the groove 26 so that the land 32 separating the dimple from the groove may be considered an interruption of the groove.

A narrow inner edge 34 of the foot or base 18 of the square/wrench 10 lies in a plane perpendicular to the edges 22, 24 of the blade 16 and the foot 18 is offset so that most of the edge 34 is offset from the plane of the blade 16. This is achieved by making a series of spaced apart parallel bends 36, 38, 40, each parallel to the edges of the blade 16 and made so as to define an elongated flat portion 42 and an inclined end tab 44. The end tab 44 includes a hexagonal aperture 46, sized to fit the hexagonal retaining nut 48 of the saw blade 50 (both shown only in phantom outline in FIG. 3). Clearly, offset of the foot or base portion 18 could be achieved with other bend arrangements.

As seen in the drawings, substantial portions of the edge 34 of the foot 18 are offset from the plane of the blade 16 so that these edge portions define a support or reference plane surface 52, extending perpendicular to the plane of the blade 16. (This plane 52 is seen in edge view in FIG. 2).

As seen in FIG. 3 the form of the saw 14 is generally conventional. It includes a motor 54 whose output shaft 56 carries the blade 50, retained by nut 48. The blade is shielded at least partially by a blade housing 58. An operator controls the saw by means of handles 60, 62 and a trigger switch 64.

The overall form of the shoe 12 which supports the saw on a workpiece surface is also generally conventional. Basically, it is a flat plate 66 adapted to carry the saw and including such features as side edge flanges 68, rear edge flange 70 and an opening 72 for the saw blade. Other features of the shoe 12 need not be described in detail except for those which relate to the present invention and, specifically, the provision of a receptacle 74 for reception of the blade 16 of the square/wrench 10.

The receptacle 74 is defined in part by a horizontally extending slot 76 in the rear edge flange 70 of the shoe and by a raised transverse somewhat resilient bridge member 78. The bridge member 78 (with the shoe plate 66) defines a second transverse slot 80 longitudinally in line with the first slot 76. Parallel ribs or ridges 82, 83 in the plate 66 extending generally between the slots 76, 80, further define the receptacle 74 (seen best in FIG. 4).

Figure 5:
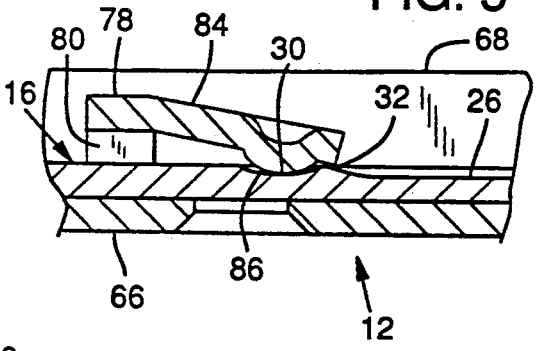
FIG. 5 is a partial enlarged cross sectional view taken on line 5—5 of FIG. 2 showing details of the arrangement for retaining the accessory tool in the shoe.
Figure 4:
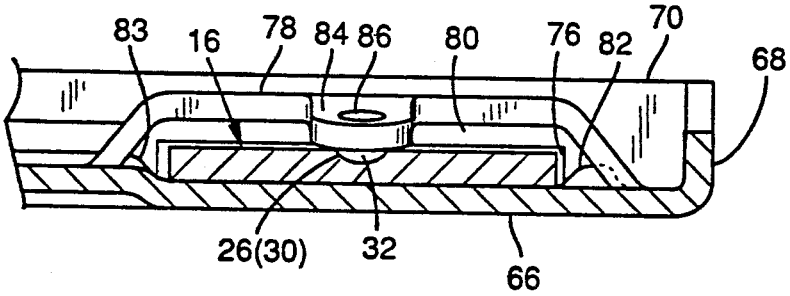
FIG. 4 is an enlarged cross sectional view taken on line 4—4 of FIG. 2.

As seen best in FIGS. 4 and 5, the somewhat resilient bridge member 78 includes a short centrally and forwardly extending, slightly depressed arm 84 carrying, at its forward extremity, a downwardly facing boss 86 which serves as a guide element, as explained below.

In operation, the square/wrench 10 is carried snugly by the saw with the blade 16 of the square wrench housed in the receptacle 74 of the shoe 12. The forward edge 34 of the base 18 abuts the rear edge 70 of the shoe 12. The only exposed portion of the square wrench, foot or base 18, is unobtrusive and only slightly extends the overall length of the shoe 12, and leaves the sides and forward edges of the shoe completely unencumbered. (See FIGS. 2 and 3).

The blade 16 of the square wrench 10 is easily inserted into the receptacle 74 of the shoe and once in position is securely retained. After insertion of the free end 28 of the blade through the slot 76 in the rear edge of the shoe the blade may be guided by the longitudinal ribs or ridges 82, 83 towards the forward slot 80. Thereafter, further guidance is given by the resilient engagement of the boss or guide element 86 on the bridge member 78 in the groove 26 of the blade 16. Insertion continues until the boss 86 encounters the land 32 at the end of the groove 26. A final thrust of the square/wrench 10 springs the resiliently supported boss 86 over the land 32 into the dimple 30 of the blade 16 and retains the blade in the receptacle. The square/wrench 10 is readily removed from the shoe 12 by applying the moderate retracting force required to "ride" the boss 86 out of the dimple 30.

Figure 6:
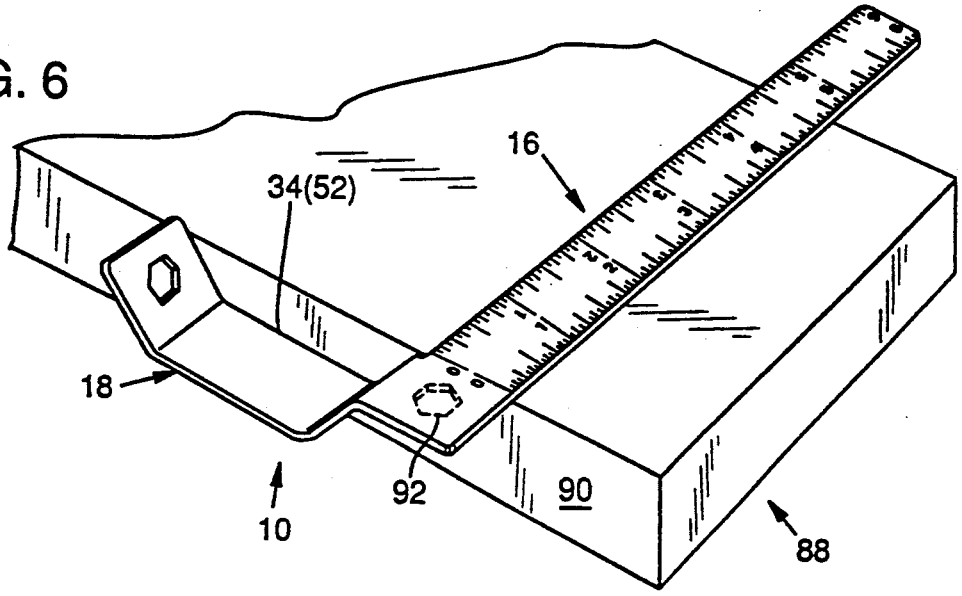
FIG. 6 is a perspective view showing the accessory tool in use as a square.

FIG. 6 illustrates the square/wrench 10 in use as a square. It is in position on a workpiece (board 88) with reference or support surface 52 defined by edge 34 against an edge 90 of the board, in preparation for "squaring off" the board ready for an intended cut.

When a saw blade must be changed the accessory tool 10 becomes a handy wrench, the angling of the wrench portion, end tab 44, facilitating the use of the hexagonal wrench opening 46 in removing the retaining nut 48 of the saw blade 50. If desired, the wrench opening (46) may be located elsewhere on the square/wrench 10, such as in the heel of the tool where blade 16 and base 18 meet (see hex 92 shown in phantom in FIG. 6). Multiple wrench openings may also be provided. The square/wrench 10 may also be modified to provide other functions (not shown in the drawings).

The square/wrench 10, in association with the saw 14 with its receptacle 74, is thus an exemplary embodiment of an accessory tool providing at least two functions and which may be carried securely and unobtrusively on the power tool and which is readily and conveniently stored on the tool and removed when needed. And when needed it is conveniently at hand so that tool operation may continue efficiently without the interruption and inconvenience of searching for a misplaced accessory tool such as a blade wrench or square.

I claim:

1. A power tool and an accessory tool in combination comprising:

a power saw having a blade secured by a retainer and including a shoe having opposite side edges and a rear edge;

means for holding an accessory tool in the shoe; and a generally L-shaped accessory tool, the L-shape being defined by an elongated blade member and a base member perpendicular to the blade member, each member having at least one straight edge, said respective at least one straight edges cooperating to define a 90 degree angle, the blade member being sized for reception by the means for holding of the shoe and in assembly, the at least one straight edge of the base member abutting the rear edge of the shoe.

2. The combination of claim 1 wherein the blade member is planar and the at least one straight edge of the base member includes a straight edge portion offset from the plane of the blade member.

3. The combination of claim 2 wherein the form of the accessory tool is substantially that form which would result if it were made from a sheet material, and if the base member included at least one bend to create the offset of the straight edge portion of the base member.

4. The combination of claim 1 wherein the blade member is graduated to facilitate measurement of a workpiece.

5. A power tool and an accessory tool in combination comprising:

a power saw having a blade secured by a retainer and including a shoe having opposite side edges and a rear edge;

means for holding an accessory tool in the shoe, the means for holding including a guide element resiliently supported by the shoe and inset from an edge of the shoe, the guide element for engaging the blade member;

a generally L-shaped accessory tool, the L-shape being defined by an elongated blade member and a base member perpendicular to the blade member, each member having at least one straight edge, said respective at least one straight edges cooperating to define a 90 degree angle and the blade member being sized for reception by the means for holding of the shoe.

6. A power tool and an accessory in combination comprising:

a power saw having a blade secured by a retainer and including a shoe having opposite side edges and a rear edge;

means for holding an accessory tool in the shoe, the means for holding including a guide element inset from an edge of the shoe, the guide element for engaging the blade member;

a generally L-shaped accessory tool, the L-shape being defined by an elongated blade member and a base member perpendicular to the blade member, each member having at least one straight edge, said respective at least one straight edges cooperating to define a 90 degree angle and the blade member being sized for reception by the means for holding of the shoe; and the blade member including an elongated feature for engaging the guide element, the elongated feature interrupted to create a stop for retaining the accessory tool in the shoe.

7. A power tool an an accessory tool in combination comprising:

a power saw having a blade secured by a retainer and including a shoe having opposite side edges and a rear edge;

means for holding an accessory tool in the shoe the means for holding including a guide element inset from an edge of the shoe, for engaging the blade member;

a generally L-shaped accessory tool, the L-shape being defined by an elongated blade member and a base member perpendicular to the blade member, each member having at least one straight edge, said respective at least one straight edges cooperating to define a 90 degree angle and the blade member being sized for reception by the means for holding of the shoe; and the blade member including a groove parallel to the at least one straight edge of the blade member and engagable with the guide element.

8. A power tool and an accessory tool in combination comprising:

a power saw having a blade secured by a retainer and including a shoe having opposite side edges and a rear edge;

means for holding an accessory tool included in the shoe;

a generally L-shaped accessory tool, the L-shape being defined by an elongated blade member and a base member perpendicular to the blade member, each member having at least one straight edge, said respective at least one straight edges cooperating to define 90 degree angle and the blade member being sized for reception by the means for holding of the shoe; and the accessory tool including a wrench element for manipulating the saw blade retainer and releasing the saw blade.

9. The combination of claim 8 wherein the wrench element is included in the base member of the accessory tool.

* * * * *